United States Patent [19]

Brugger

[11] 4,343,345

[45] Aug. 10, 1982

[54] PROCESS OF APPLYING A TITANIUM DIOXIDE COATING TO A CENTRIFUGAL CASTING MOLD

[76] Inventor: Gottfried Brugger, Werksgelände 5, Mitterberghütten, Austria, A-5503

[21] Appl. No.: 179,245

[22] Filed: Aug. 18, 1980

[51] Int. Cl.[3] ..... B22D 13/10

[52] U.S. Cl. ..... 164/33; 106/38.27; 164/72; 164/114; 164/138; 427/135

[58] Field of Search ..... 164/72, 33, 114, 138; 427/135; 106/38.27

[56] References Cited

U.S. PATENT DOCUMENTS

| | | | |
|---|---|---|---|
| 3,437,131 | 4/1969 | Ornitz | 164/33 X |
| 4,150,709 | 4/1979 | Brügger | 164/72 |
| 4,178,981 | 12/1979 | Murray | 164/72 |

FOREIGN PATENT DOCUMENTS

| | | | |
|---|---|---|---|
| 51-96734 | 8/1976 | Japan | 427/135 |
| 52-34249 | 9/1977 | Japan | 164/33 |

*Primary Examiner*—Gus T. Hampilos

*Assistant Examiner*—J. Reed Batten, Jr.

*Attorney, Agent, or Firm*—Salter & Michaelson

[57] ABSTRACT

A mold facing for producing a gas-permeable, non-gassing and, in view of its small thickness and its porosity, heat-conductive cladding of a centrifugal ingot mold for copper and its alloy contains pulverulent material in a dispersing agent, particularly water, evaporating without residue. The pulverulent material has titanium dioxide ($TiO_2$) as the main constituent or the sole constituent, preferable with an average particle sizes of about 15 $\mu$m. A process for cladding a centrifugal ingot mold by using such a mold facing contemplates at first preheating the mold and subsequently applying the mold facing by spraying to the inner wall of the centrifugal ingot mold rotating around its axis in form of a suspension free of binding agents and surface active agents as a thin layer of, as far as possible, uniform thickness of preferably 0.1 to 0.3 mm and subsequently evaporating the dispersing sheet of the mold facing without leaving any residue for obtaining a porous layer.

11 Claims, No Drawings

PROCESS OF APPLYING A TITANIUM DIOXIDE COATING TO A CENTRIFUGAL CASTING MOLD

FIELD OF THE INVENTION

The present invention relates to a mold facing for producing a gas-permeable, non-gassing and, in view of its small thickness and its porosity, heat-conductive cladding of a centrifugal ingot mold for copper and its alloys, said mold facing containing pulverulent material in a dispersion agent, particularly water, evaporating without residue. The invention further relates to a process for cladding a centrifugal ingot mold for casting copper or its alloys.

BACKGROUND

Tubular pieces of copper or copper alloys, particularly bronze, which serve as blanks for manufacturing bushings, rings and other shaped articles suffered, up till now, from the drawback that the outer layer showed gas inclusions over a substantial depth so that the blanks had to be turned on a lathe over this depth, whereas the inner layer of these blanks were formed of a porous layer containing oxides. With the centrifugal casting methods used up till now for casting copper and copper alloys, the centrifugal ingot mold had to be filled with a relatively low speed for avoiding so-called through-holes which resulted in nonuniform charging of the mold, inaccuracies at the inner side of the casting and to nonuniform temperature stress of the mold which in turn results in increased consumption of materials and in a rapid wear of the mold.

SUMMARY OF THE INVENTION

It is an object of the invention to avoid the mentioned drawbacks. It is a further object of the invention to improve the process for cladding a centrifugal ingot mold for casting copper or its alloys, particularly with respect to the quality of the castings produced and its mechanical properties (above all tension strength, elongation on rupture and Brinell Hardness) so that even castings of copper or copper alloys of very small wall thickness can be produced without faults in a centrifugal casting process. These objects are, according to the invention essentially achieved in that the mold facing comprises titanium dioxide ($TiO_2$) as the main constituent or as the sole constituent of the pulverulent material. It has been shown that by using such a mold facing still further results, particularly still thinner castings of good quality can be obtained as compared with the use of the previously described mold facing based on zirconium dioxide. The reduction of the minimum wall thickness of the castings is particularly impressive if the pulverulent material of the mold facing is only titanium dioxide, particularly pure titanium dioxide, most preferable titanium dioxide of a purity of 99 percent. An advantage resulting by using titanium dioxide of as high a purity as possible is, in addition, that titanium dioxide has a density of 4.8 to 5.0 whereas the density of zirconium dioxide is about 9.0 to 9.5. This difference not only results in a lower weight of the cladding formed on the internal wall of the mold but has also as a consequence that titanium dioxide can, in view of its lower density, be kept longer dispersed with a dispersing agent than zirconium dioxide.

Pulverulent titanium dioxide does, however, strongly tend to dust formation. If this disturbs the mold facing can, according to the invention, be modified such that the pulverulent material consists of titanium dioxide, up to 50 percent by weight zirconium dioxide (zirconia) and up to 5 percent by weight aluminum oxide ($Al_2O_3$). The term zirconia represents a naturally occurrying product or ore comprising as main constituents zirconium dioxide ($ZrO_2$) and silicon dioxide ($SiO_2$). Also these mixtures when used as the pulverulent material for a mold facing according to the invention give better results than a mold facing as initially mentioned and based on zirconium dioxide. The reduction of the minimum wall thickness is, in this case, not so impressive as compared with a mold facing based on zirconium dioxide, so that castings of such a thin wall thickness can no more be produced. However, cleaning of the castings is facilitated and dust formation, particularly by adding $Al_2O_3$ or zirconia, is avoided.

According to the invention, the titanium dioxide used conveniently has an average particle size of approximately 15 μm. The apparent density of such a pulverulent titanium dioxide is approximately 3.9 and the residue on a sieve having a mesh size of 63 μm is less than 0.01 percent by weight and on a sieve with a mesh size of 44 μm is somewhat more than 0.05 percent by weight. The particle size of the sieve residue is, as measured according to DIN-Standard 53195, somewhat greater than 63 μm. Titanium dioxide having another particle size than the initially mentioned particle size, particularly titanium dioxide having a coarser grain, can, however, also be used with good results when producing castings, it becomes, however, more difficult to apply a mold facing containing titanium dioxide of coarse grain on the mold surface and a greater thickness of the mold facing must be chosen, so that the heat transition resistance as contributed by the mold facing increases.

In all cases, it has been proven that the mold facing comprising titanium dioxide as the main constituent or as the sole constituent is completely free of any gas deliberation. One reason for this fact could be that the melting point of titanium dioxide is very high (higher than 1800° C.) and that the titanium dioxide becomes not decomposed up to temperatures of approximately 1400° C. and can thus not give off free gases. The cladding formed on the inner surface of the mold is thus over its whole thickness wholly at disposal for transporting gases emerging from the melt and need not transport gases produced from this cladding itself. Furthermore, any gas transport from the cladding to the cast metal is precluded.

As already mentioned, the starting temperature of the centrifugal ingot mold on casting operation can be kept lower when using a mold facing according to the invention. This provides for reducing the so-called steam cushion effect to be observed when cooling the mold and this effect may even be avoided. The steam cushion effect has its origin in the formation of a steam layer formed between the mold and the cooling water and substantially reducing the heat extraction from the mold. By reducing this effect, cooling of the mold can be strongly intensified under otherwise equal conditions. This has as a result a more rapid solidification of the melt, so that a casting of finer grain and of better properties can be obtained. It is known that solidification of molten copper or copper alloys cast in a centrifugal casting process shall be effected as rapidly as possible in contrast to centrifugal casting of steel or the like where such a rapid cooling of the melt shall be avoided.

In this connection, it is also of importance that the mold facing according to the invention provides a porous cladding of the mold wall, which porosity substantially contributes to the gas-permeability of the cladding. During casting operation, the mold facing substantially maintains its porous character in spite of the melt partially penetrating into the tiny pores of the thin layer formed of the mold facing, which, however, is improving the heat transfer from the melt to the mold wall because part of the melt comes nearer to the inner wall of the mold. Irrespective of this phenomenon, a sufficient portion of the pores remains free for providing the required gas-permeability of the mold facing so that gases, if any, formed on the outer side of the casting, are reliably transported by the cladding formed of the mold facing in outward direction and in direction to the end portions of the mold.

The inventive process of cladding a centrifugal ingot mold for casting copper or its alloys by using a mold facing of the kind initially described essentially consists in that the centrifugal ingot mold is first, in a manner known per se, preheated to a temperature of preferably about 140° to 170° C., in that subsequently the mold facing is applied by spraying to the inner wall of the rotating centrifugal ingot mold in form of a suspension free of binding agents and surface active agents as a thin layer of, as far as possible, uniform thickness of preferably 0.1 to 0.3 mm and in that the dispersing agent of the mold facing is evaporated without leaving any residue for obtaining a porous layer. It could be shown that in this manner the initially mentioned inventive mold facing can be applied in a most favorable manner and that by working according to such a process the advantageous properties of the mold facing can best be realized or maintained, respectively. It is of supreme importance that the mold facing and the cladding of the mold produced therewith be as far as possible free of binding agents and of surface active agents because binding agents and surface active agents, respectively, would detract from the porosity of the inventive mold facing which is reliable for the favorable behavior of the mold facing according to the invention. For the same reason, the temperature of the centrifugal ingot mold must be maintained within the range of about 140° to 170° C. during applying the mold facing. It has further been shown that spraying of the mold facing onto the inner wall of the rotating mold provides essentially better results than pouring the mold facing into the rotating mold or applying the mold facing by brushing. Pouring the mold facing into the mold results in unequal areas within the cladding whereas wear of the brush can not be avoided when applying the mold facing by brushing. Spraying of the mold facing into the mold can be effected by means of pressurized air. The preferred embodiment of the inventive process consists, in this case, in that the mold facing is applied to the internal wall of the centrifugal ingot mold in a plurality of layers by means of a spray nozzle, said spray nozzle being repeatedly reciprocated at such a distance from the preheated mold wall that the previously applied layer is desiccated prior to applying the next layer. In this manner, it can be made sure that the cladding layer applied is dried on its surface with a higher speed than grains of titanium dioxide are subsequently delivered, thereby securing in the best manner the porous property of the cladding. In this case it is favorable if, according to the invention, the centrifugal ingot mold is, during applying the mold facing by spraying, rotated around its axis with a smaller number of revolutions than during casting the molten metal. The compacting effect on the mold facing applied, for which effect the centrifugal forces are responsible, can thus be kept within tolerable limits.

The dispersing agent which is best suitable for a mold facing according to the invention is water, however, also other dispersing agents evaporating without residue, such as alcohol, could be used. From an economic standpoint, water is the preferred dispersing agent for producing the dispersion or suspension, respectively. Water used as the dispersing agent provides the possibility to rapidly evaporate, according to the invention, the dispersing agent, thereby loosening the texture of the cladding by the steam or foam, respectively, escaping in inward direction through the cladding. This will increase the porosity of the cladding. The loosened texture does not collapse after escape of the steam or foam, respectively, because the relatively small grains of titanium dioxide have a relatively rough surface and an irregular shape, respectively, and are thus mutually supporting themselves, which is equivalent to felting or mat formation. The cladding becomes somewhat compacted when applying the molten metal, but the cladding remains porous to such an extent that the gases can be vented in an unobjectional manner along the layer formed by the cladding.

It has been shown that for obtaining the mentioned foam formation it is essential to maintain the mentioned mold temperature of about 140° to 170° C. With temperatures of substantially less than 140° C. of the mold, the evaporating water does no more give rise to foam formation. With temperatures substantially exceeding 170° C., for example with temperatures of 200° C., of the mold, the liquid suspension applied to the hot mold surface does no more wet this surface. For the purpose of the present invention, the best suitable dispersing agent is distilled water or soft water of low lime content and as far as possible free of contaminations and having a degree of hardness, as expressed in German Degrees of Water Hardness, of 8*d* as the maximum. Such water has the quality of drinking-water having, however, a low lime content.

DESCRIPTION OF PREFERRED EMBODIMENT

Example 1

A tubular blank for producing friction bearings shall be produced from bronze having a composition according to DIN 1705, melt composition Gz-Rg 7, and having an outer diameter of 162 mm and an inner diameter of 150 mm, i.e. a wall thickness of 6 mm, and an overall length of 660 mm. The horizontally supported centrifugal ingot mold consisting of steel is preheated to about 155° C. and covered on its inner surface while slowly rotating with 300 revolutions per minute by means of an aqueous suspension of pure titanium dioxide having an average particle size of about 15 μm. This is effected by applying the suspension of titanium dioxide, which is free of binding agents and surface active agents and is homogenized by stirring, by means of a spray nozzle operated with pressurized air in a plurality of individual layers until a cladding having a uniform thickness of about 0.2 mm is formed. The spray nozzle is repeatedly reciprocated along the axis of the mold. The water contained in the suspension applied by spraying does rapidly evaporate with foam formation so that after escape of the water vapor or foam a cladding consisting of mutually interlocked titanium dioxide grains of irregular shape is formed with a high degree of porosity on the inner wall of the mold. The distance of the spray nozzle from the heated mold wall is during reciprocating the spray nozzle selected such and the temperature of the mold is selected sufficiently high to make sure that after each reciprocating movement of the spray nozzle the just applied layer of suspension has become dry prior to applying the next layer of suspension. After having obtained an overall thickness of the cladding of about 0.2 mm, further supply of suspension is terminated and, as soon as the cladding has become dry, the mold is closed and provided with a pouring device for molten metal. By means of this pouring device, a weighed amount of molten metal heated at a temperature of more than 1150° C. is poured into the mold which is now rotated with a substantially higher speed over that used when applying the cladding, i.e. a speed of 500 revolution per minute. The casting operation is effected by using a pouring funnel within which a bath level of about 200 mm is maintained so that a constant trough-put and thus also a uniform supply of melt into the mold results within the pouring spout of the pouring funnel. The pouring interval extends over about 4 seconds. After having finished the pouring operation, the pouring device is removed and the mold is cooled with water, whereupon the solidified blank is removed from the mold.

The following table illustrates the improvement of the technical properties, particularly the substantial increase of the Brinell Hardness obtained with thin wall thickness of the blank, as compared with the values required by DIN.

| | According to DIN 1705 for Gz-Rg 7 | according to the inventive process |
|---|---|---|
| tensile strength (kp/mm$^2$) | 30 | 32 |
| elongation on fracture (%) | 20 | 25 |
| Brinell Hardness (kp/mm$^2$) | 85 | 95 to 110 |

The invention is particularly suitable for casting copper and such copper alloys, in which copper is an essential constituent or a main constituent, into ingot molds, i.e. repeatedly useable molds or permanent molds, respectively.

EXAMPLE 2

A blank having a wall thickness of 12 mm is produced according to Example 1 with the modification that an aqueous suspension is selected containing 70 percent by weight titanium dioxide and 30 percent by weight zirconia.

EXAMPLE 3

A blank having a wall thickness of 16 mm is produced in a manner described in Example 1 with the exception that the composition of the aqueous suspension for producing the cladding is selected with 50 percent by weight titanium dioxide and 50 percent by weight zirconia (main constituents $ZrO_2$ and $SiO_2$, traces of $Al_2O_3$).

What I claim is:

1. A process for applying a heat-conductive gas-permeable, non-gas producing and porous coating to a centrifugal casting mold for casting copper or alloys thereof, said mold having an internal surface, said process comprising the steps of preheating the mold, spraying onto the internal surface of the mold after the preheating thereof a suspension of powdery material in a liquid dispersion agent of distilled water having a low-lime content, the main constituent of said powdery material being titanium dioxide, said suspension being substantially free of binding agents and surface active agents, said step of spraying said suspension being performed as the mold is rotated to form a thin layer therein and evaporating rapidly the liquid dispersion agent so that steam and foam of this agent escape in inward direction through said layer thereby loosening the texture of said layer.

2. A process as claimed in claim 1, wherein titanium dioxide is the sole constituent of the powdery material.

3. A process as claimed in claim 1, wherein said powdery material contains pure titanium dioxide.

4. A process as claimed in claim 1, wherein said powdery material contains titanium dioxide with a purity of 99 percent.

5. A process as claimed in claim 1, wherein said powdery material consists of titanium dioxide, zirconium dioxide and up to 5 percent by weight aluminum oxide.

6. A process as claimed in claim 1, wherein said titanium dioxide has an average particle size of approximately 15 μm.

7. A process as claimed in claim 1, wherein said layer is applied to said internal surface with substantially uniform thickness.

8. A process as claimed in claim 7, wherein said suspension is applied to the internal surface of the centrifugal mold in a thickness of 0.1 to 0.3 mm.

9. A process as claimed in claim 1, wherein said mold is preheated to a temperature of 140° to 170° C.

10. A process as claimed in claim 1, wherein said suspension is applied to said internal surface in a plurality of layers by means of a spray nozzle, said spray nozzle being repeatedly reciprocated in such a distance from the preheated mold surface so that the previously applied layer is desiccated prior to applying the next layer.

11. In the process of claim 1, said distilled water having a maximum hardness of 8*d* as expressed in German degrees of water hardness.

* * * * *